US005301387A

United States Patent [19]

Thomas et al.

[11] Patent Number: 5,301,387

[45] Date of Patent: Apr. 12, 1994

[54] CLEANING HEAD FOR FLAT SURFACES

[75] Inventors: Gilbert P. Thomas, Soliers; Jacky Y. L. Leguay, Plaine, both of France

[73] Assignee: Moulinex (Societe Anonyme), Bagnolet, France

[21] Appl. No.: 972,923

[22] Filed: Nov. 6, 1992

[30] Foreign Application Priority Data

Nov. 12, 1991 [FR] France ..... 91 13881

[51] Int. Cl.[5] ..... A47L 13/12

[52] U.S. Cl. ..... 15/322; 15/364; 15/393; 15/401

[58] Field of Search ..... 15/322, 321, 320

[56] References Cited

U.S. PATENT DOCUMENTS

| | | | |
|---|---|---|---|
| 1,982,345 | 11/1934 | Kirby | 15/322 X |
| 3,195,166 | 7/1965 | Wisner | 15/322 X |
| 3,538,535 | 11/1970 | Ginsburgh et al. | 15/322 X |
| 4,817,233 | 4/1989 | Waldhauser | 15/320 |
| 4,833,752 | 5/1989 | Merrick | 15/322 |
| 5,127,128 | 7/1992 | Lee | 15/322 |

FOREIGN PATENT DOCUMENTS

| | | | |
|---|---|---|---|
| 0235614 | 9/1987 | European Pat. Off. . | |
| 0447627 | 9/1991 | European Pat. Off. . | |
| 1922651 | 12/1970 | Fed. Rep. of Germany . | |
| 87167484 | 3/1988 | Fed. Rep. of Germany . | |
| 1554790 | 1/1969 | France . | |
| 368275 | 6/1963 | Switzerland | 15/339 |
| 683749 | 4/1991 | United Kingdom . | |

*Primary Examiner*—Chris K. Moore
*Attorney, Agent, or Firm*—Young & Thompson

[57] ABSTRACT

A cleaning head for flat surfaces comprises a device (1) for distribution of cleaning liquid which comprises an injection pipe (2) connected to a washing device (3) located in a cleaning region (4) of the head, and a suction chamber (10) which is connected to a suction passageway (12) and which is disposed adjacent the cleaning region (4) between a scraper (13) and the washing device (3), so as to suck up the liquid and the dirt. The washing device (3) comprises a permeable body (5) onto which discharges the pipe (2) and which is flanked by two scrubbers (6, 7) comprising brushes disposed on opposite sides of the permeable body (5) and disposed substantially transversely to the surface to be cleaned. A second suction chamber (11) is disposed symmetrically relative to the permeable body (5) between one (7) of the brushes and a second scraper (14). The brushes (6, 7) and the scraping devices (13, 14) are disposed on the one hand symmetrically and parallel to the permeable body (5) and on the other hand transversely to the direction (D) of movement of the head.

5 Claims, 2 Drawing Sheets

CLEANING HEAD FOR FLAT SURFACES

FIELD OF THE INVENTION

The invention relates to a cleaning head for flat surfaces adapted to be used with a cleaning apparatus that disperses a liquid and sucks up the dirt.

The invention relates more particularly to a cleaning head for flat surfaces comprising a device for distribution of cleaning liquid which comprises an injection pipe connected to a washing means located in a cleaning region of the head, and a suction chamber which is connected to a suction nozzle and which is disposed adjacent the cleaning region between a scraping device and the washing means, so as to suck up the liquid and the dirt.

BACKGROUND OF THE INVENTION

In known apparatus of this type, the washing means, for example of felt or sponge, is oriented relative to a suction opening such that during a working stroke, the cleaning device travels in the first instance over the surface to be cleaned, and the suction chamber then travels over it to evacuate the liquid-dirt mixture and partially to dry the surface. However, this type of head is preferably used with back and forth movement, which has the drawback of leaving the surface foamy when the user returns the cleaning head in the opposite direction, because the cleaning device follows behind. The user must therefore retrace exactly along the paths of moisture, which is difficult, or else, at each return stroke, raise the cleaning head, which can lead to dripping. To overcome this drawback, certain cleaning heads can swing between two positions, a position to wash and a position to scrape the cleaned surface and to apply suction. This solution requires two successive passes of the cleaning head by the user. These devices have the drawback of being difficult and complicated to handle.

The invention has for its object to overcome these drawbacks and in particular to provide a cleaning head particularly easy to use while being effective and inexpensive.

SUMMARY OF THE INVENTION

According to the invention, the washing means comprise a permeable body onto which opens the pipe and which is flanked by two scrubbing means comprising brushes disposed on opposite sides of the permeable body and disposed substantially transversely to the surface to be cleaned, while a second suction chamber is disposed symmetrically relative to the permeable body between one of said brushes and a second scraping device.

Thus the user can proceed by a single operation both to clean by application of liquid and to suck up the dirt while eliminating traces of moisture, no matter what the direction of use of the head, because the suction chambers and the scraping devices are distributed on each side of the washing means. The user can thus use the head with back and forth movement without being careful of its position. Moreover, the assembly of the permeable body with the brushes permits improving the cleaning. Thus, the permeable body permits moistening the surface to be cleaned and scrubbing it, while the brushes permit loosening the dirt by brushing. The cleaning is thus more effective. As to the scraping devices, they prevent the liquid from escaping and thus trap it below each suction chamber so that it will be sucked up.

BRIEF DESCRIPTION OF THE DRAWINGS

The characteristics and advantages of the invention will become further apparent from the description which follows, by way of example, with reference to the accompanying drawings, in which.

DETAILED DESCRIPTION OF THE INVENTION

Figure 1:
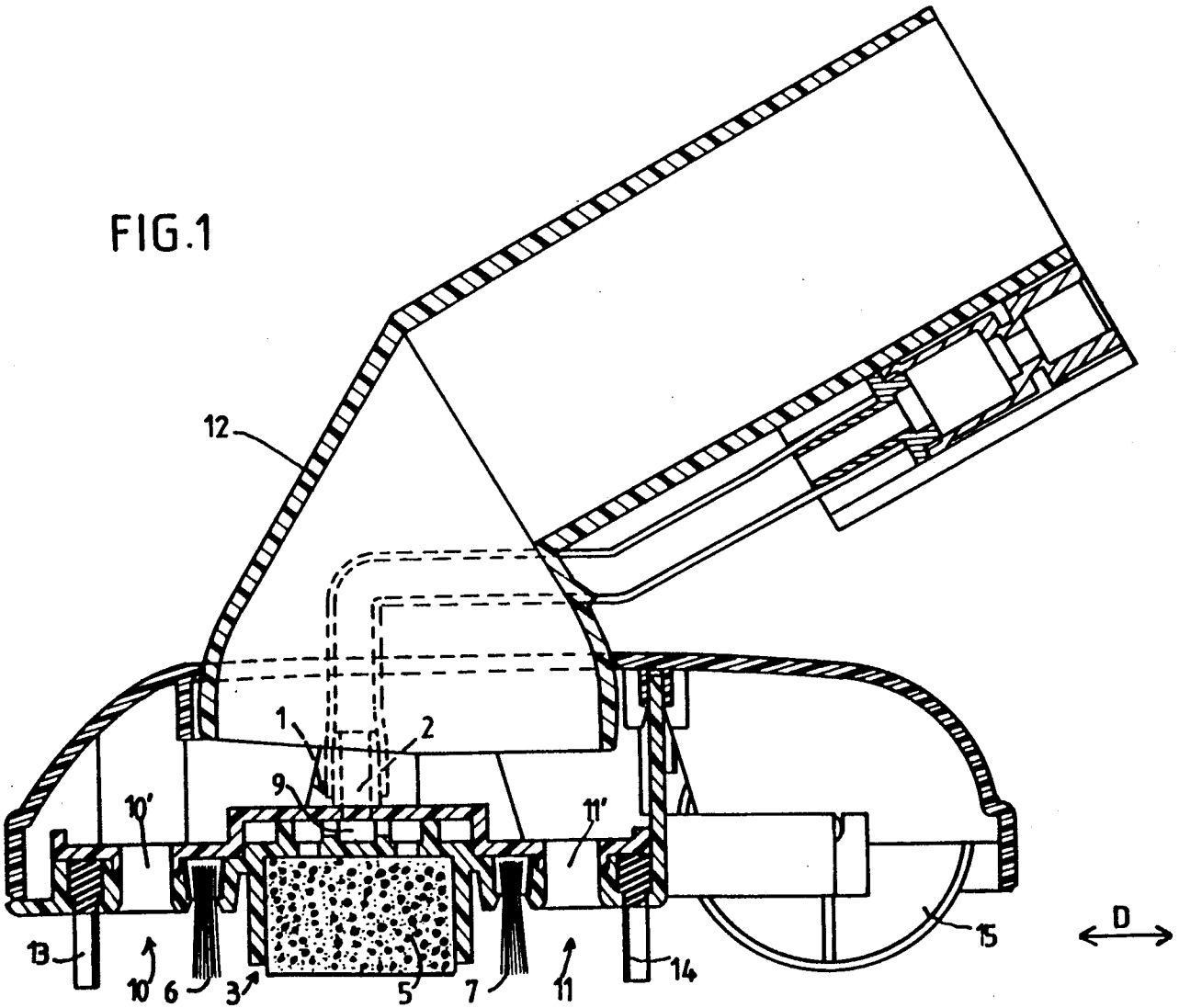
FIG. 1 is a view in transverse cross section of the cleaning head according to the invention.
Figure 2:
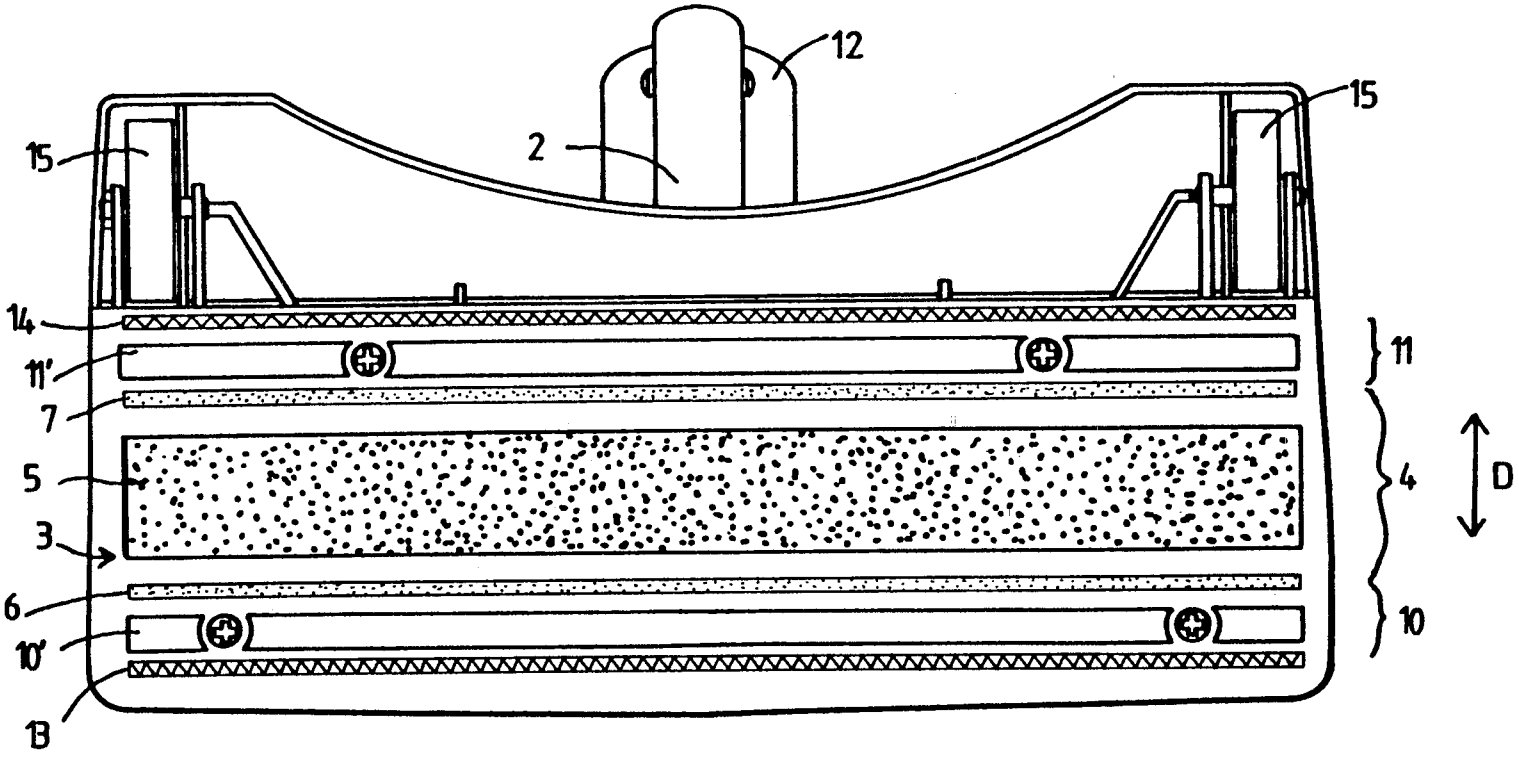
FIG. 2 is a view from below of FIG. 1, on a different scale.

The cleaning head for flat surfaces shown in FIGS. 1 and 2 comprises a device 1 for distribution of cleaning liquid which comprise an injection pipe 2 connected to a washing means 3 located in a cleaning region 4 of the head.

According to the invention, the washing means 3 comprises a permeable body 5 onto which opens the pipe 2 and which is constituted by a porous absorbent material such as for example sponge or plastic cellular foam. Moreover, the permeable body 5 is flanked by two scrubbing means 6, 7 comprising brushes disposed on opposite sides of the permeable body 5 and disposed substantially transversely to the surface to be cleaned (not shown).

The device 1 for distribution of liquid comprises preferably a diffusion chamber 9 interposed between the injection pipe 2 and the permeable body 5 so as to distribute the cleaning liquid over all the extent of the permeable body 5.

Moreover, the cleaning head comprises two suction chambers 10, 11 which are connected to a suction nozzle 12 by means of openings 10', 11' provided in the head and which are disposed adjacent the cleaning region 4, so as to suck up the liquid-dirt mixture.

A first chamber 10 is located between a scraping device or squeegee 13 and a brush 6 of the cleaning means 3, while a second suction chamber 11 is disposed symmetrically relative to the permeable body 5, between the other brush 7 and a second scraping device or squeegee 14.

The scraping devices or squeegees 13, 14 are constituted by blades of flexible material such as for example rubber, and are disposed substantially transversely to the surface to be cleaned.

Thus, the brushes 6, 7 and the scraping devices 13, 14 are disposed on the one hand symmetrically and parallel to the permeable body 5 and, on the other hand, transversely to the direction D of travel of the head, and extend over practically all the width of the cleaning head.

The cleaning head comprises also a pair of rollers 15 adapted to balance the force applied to the head by means of the nozzle 12. Thus the rollers contribute to avoiding premature wear of the scraping device and flattening of the brushes, because it is necessary that only the end of the brushes be in contact with the surface for good brushing. The rollers 15 are disposed at the sides of the cleaning head behind the scraping blade 14 so as to avoid leaving tracks of the wheels.

The suction nozzle 12 is mounted pivotally on the cleaning head, so as to facilitate manipulation of the cleaning head by a tube forming a sleeve (not shown).

As will be understood, the operation of the cleaning head according to the invention is particularly simple.

The user can pass the cleaning head over the surface to be cleaned with back and forth movement. The injection pipe 2 delivers cleaning liquid into the diffusion chamber 9 which distributes the liquid over all the extent of the permeable body 5. The permeable body 5 scrubs and thus moistens the surface, and the back and forth movement of the head contributes to the dissolution and loosening of the dirt. Simultaneously, the brushes 6, 7 dig out the dirt which would adhere more strongly to the surface. The cleaning is thus more effective. Then the liquid-dirt mixture is sucked up into the suction chambers 10, 11, since the scraping blades 13, 14 contribute to maintaining the liquid below each suction opening 10', 11'.

The fact that the suction openings 10', 11', the scraping blades 13, 14 and the brushes 6, 7 are distributed symmetrically on each side of the permeable body 5 permits the utilizer to effect, in a single operation, both the cleaning and the suction, no matter what the direction D of working. Thus, one of the suction chambers 10 or 11 always moves behind the cleaning region 4, no matter what the orientation of the head.

To dry the surface completely, it suffices for the user to cut off in a manner known per se, the feed of liquid to the cleaning device 1, and thus the suction removes any trace of moisture.

The permeable body 5 is itself continuously washed, because the renewal of the cleaning liquid itself displaces the dirty liquid which has been in contact with the surface to be cleaned. The cleaning thus is done both by the back and forth movements effected by the user and by the action of the liquid itself which displaces the dirty liquid.

As to the scraper blades 13, 14, these are chosen to be slightly longer than the brushes and extend beyond the rollers. They curve during back and forth movement so as to scrape the surface more effectively. Thus, the scraper blade 13 or 14 which follows behind the cleaning region 4 will curve outwardly of the corresponding suction chamber 10 or 11 such that said chamber 4 will be completely isolated and the degree of suction augmented.

What is claimed is:

1. A cleaning head for flat surfaces comprising:

a. a device for distribution of cleaning liquid and including:

i) an injection pipe;

ii) washing means comprising a permeable body which is constituted by a porous absorbent material and in which discharges said injection pipe;

b. two brushes disposed symmetrically relative to said permeable body and disposed substantially transversely to the surface to be cleaned;

c. two squeegees constituted by blades of flexible material and disposed symmetrically relative to said permeable body and outside of said brushes;

d. a first suction chamber connected to a suction nozzle and disposed between one of said brushes and one of said squeegees;

e. a second suction chamber connected to said suction nozzle and disposed between the other brush and the other squeegee.

2. A cleaning head as claimed in claim 1, wherein said brushes and said squeegees are disposed parallel to said permeable body and transversely to the direction of movement of the head.

3. A cleaning head as claimed in claim 1, wherein said device for distribution of cleaning liquid further comprises a diffusion chamber interposed between said injection pipe and said permeable body so as to distribute the cleaning liquid over all the extent of said permeable body.

4. A cleaning head as claimed in claim 1, further comprising a pair of rollers adapted to balance force applied to the head by means of said suction nozzle.

5. A cleaning head as claimed in claim 1, wherein said suction nozzle is mounted pivotally on the cleaning head.

* * * * *